US006749692B2

(12) United States Patent
Holthaus

(10) Patent No.: US 6,749,692 B2
(45) Date of Patent: Jun. 15, 2004

(54) METHOD OF AND AN APPARATUS FOR OPERATING A MULTISTAGE COUNTER-FLOW CASCADE WASHER

(75) Inventor: Dirk Holthaus, Mülheim (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/816,054

(22) Filed: Mar. 22, 2001

(65) Prior Publication Data

US 2001/0039957 A1 Nov. 15, 2001

(30) Foreign Application Priority Data

Mar. 24, 2000 (DE) ..... 100 14 710

(51) Int. Cl.[7] ..... B08B 3/02
(52) U.S. Cl. ..... 134/15; 134/10
(58) Field of Search ..... 134/15, 10, 60, 134/64 R, 122 R

(56) References Cited

U.S. PATENT DOCUMENTS 3,938,214 A * 2/1976 Hodsden et al. ..... 134/60
4,039,349 A * 8/1977 Kwasnoski et al. ..... 134/10
4,319,930 A * 3/1982 Yano et al. ..... 134/10
4,996,998 A * 3/1991 Seiz et al. ..... 134/107
5,179,967 A * 1/1993 Mattiussi ..... 134/60

* cited by examiner

*Primary Examiner*—Alexander Markoff
*Assistant Examiner*—Saeed Chaudhry
(74) *Attorney, Agent, or Firm*—Sidley Austin Brown & Wood, LLP

(57) ABSTRACT

A method of operating a counterflow cascade washer for wet-chemical treatment of a surface of a metal strip and including branching a portion of a water flow, which circulates through a rinsing water circuit associated with each of the washer units off in form of a bypass stream, and feeding the bypass stream to a washer unit located immediately upstream of respective washer unit, and an apparatus for effecting the method.

1 Claim, 1 Drawing Sheet

METHOD OF AND AN APPARATUS FOR OPERATING A MULTISTAGE COUNTER-FLOW CASCADE WASHER

BACKGROUND OF THE INVENTION

1. Field of the Invention

The present invention relates to a method of an apparatus for operating a counterflow cascade washer for wet-chemical treatment of a surface of a metal strip to be located downstream of one of treatment means and aftertreatment means of a metal strip treating installation, with the counterflow cascade washer including a plurality of washer units each having means for connecting a respective washer unit with a fresh water supply and a rinsing water circuit.

2. Description of the Prior Act

A washing or rinsing process plays an important role in the wet-chemical treatment of a surface of a product, e.g., a metal strip. It not only breaks down the products of the preceding chemical reaction but also cleans the surface of the treated product and prevents carrying-on of foreign electroytes in the following process or treatment bath. Such multistage counterflow cascade washers are usually located downstream of treatment means or aftertreatment means of a strip treating installations. E.g., such a counterflow cascade washer can be arranged downstream of pickling means. However, the multistage counterflow cascade washers can be used for rinsing purposes with other strip treating means. In the multistage cascade washer, the continuously passing strip is cleaned from treatment chemicals and/or other foreign materials. The fresh water from a central fresh water source is fed into the last, in the strip displacement direction, washer stage or unit and flows therefrom in the direction opposite to the strip displacement direction through separate washer units or stages, which are separated by respective gates, to the first washer stage or unit.

The fresh water flow (the cascade flow) is controlled dependent on the surface size of the strip. In the cascade washers, a minimum cascade flow is necessary for operating the washer. The rinsing dilutes a fluid film formed on the product or strip surface. The effectiveness of rinsing increases with the increase of the dilution ratio, which is called a rinsing criterium. The rinsing criterium or the dilution ratio is determined by the concentration in the treatment bath and the concentration in the last rinsing bath.

It is the concentration in the last rinsing bath that is important for the cleanness of the treated product or strip.

Accordingly, an object of the present invention is to provide a method of and an apparatus for operating a multistage cascade washer which would insure an increased degree of cleanness of the treated product(s) by using an improved rinsing technology.

SUMMARY OF THE INVENTION

This and other objects of the present invention, which will become apparent hereinafter, are achieved by branching off a portion of a water flow circulating through a rinsing water circuit, which is associated with each of the washer units, in form of a bypass stream, and by feeding the bypass stream to a washer unit located immediately upstream of a respective washer unit, and by providing apparatus for effecting the method.

By branching off a bypass stream from the rinsing water circuit of the n+1 stage or unit and feeding the bypass stream in the immediately upstream-located n stage or unit, it is possible to subject the strip or any other treated product to additional rinsing in the n stage or unit with a rinsing water from the n+1 stage or unit containing a smaller concentration of the foreign additives.

The effectiveness of rinsing can be further increased when, according to the present invention, the bypass stream is divided at an end of the immediately upstream-located washer stage or unit, and the divided water streams are fed to locations above and below the passing strip or product. Thereby, the strip or the other product is cleaned from all sides.

The apparatus for effecting the inventive method includes a separate bypass conduit integrated into a rinsing water circuit associated with each of the washer units, and outlet means provided at an end of the bypass conduit for feeding the bypass stream to an end of a washer unit located immediately upstream of a respective washer unit.

Advantageously, the outlet means comprises blast pipes arrangeable above and below the passing strip or product.

Maintaining of a minimum cascade flow necessary for operation of the counterflow cascade washer by using bypass streams from a washer stage or unit to an immediately preceding washer stage or unit, many advantages are achieved. Namely, at the same number of washer stages or units, a reduced consumption of fresh water is obtained or at the same number of washer stages an unit and the same consumption of fresh water, an increased surface throughput is achieved. On the other hand, at the same number of washer stages and unit and the same surface throughput or the size of the treated surface, reduced consumption of fresh water is obtained. Finally, the inventive method and apparatus permit to reduce stoppage of the installation and, thereby, production of strip sections with defective surfaces (formation of hydroxide).

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
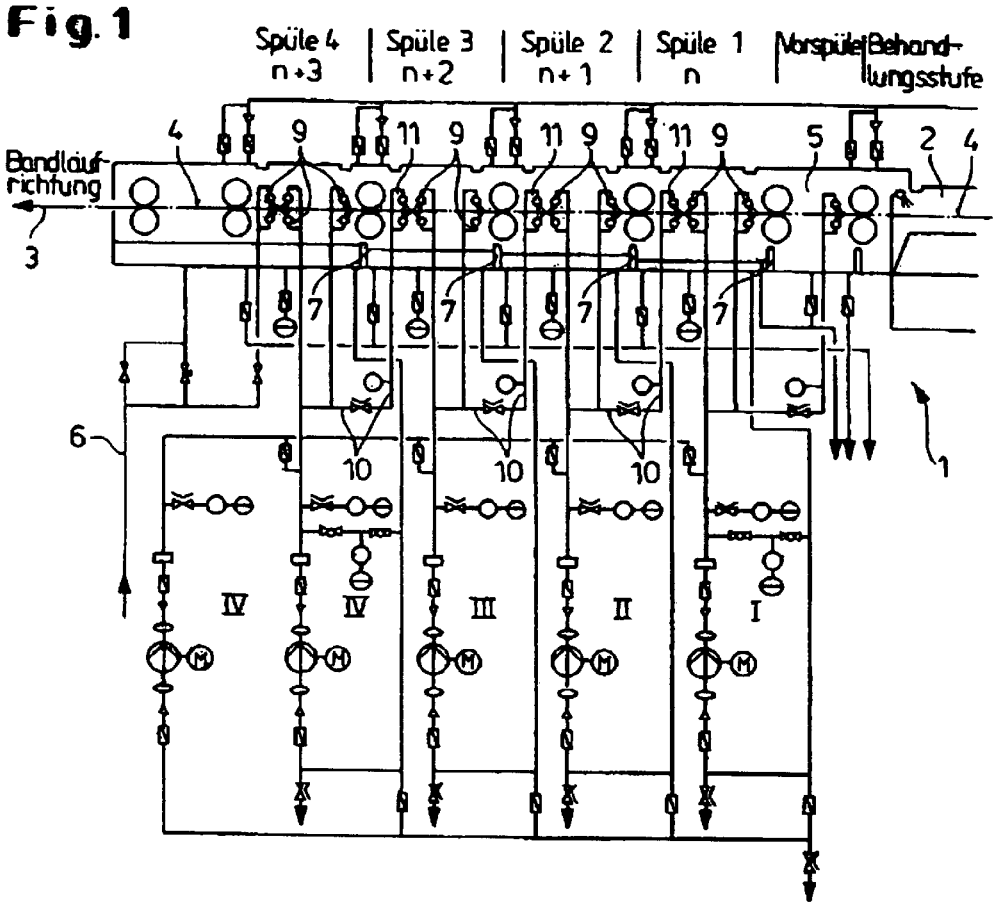
FIG. 1 a layout diagram of a counterflow cascade washer, which is arranged downstream of a strip treatment means, with rinsing water supply connections.
Figure 2:
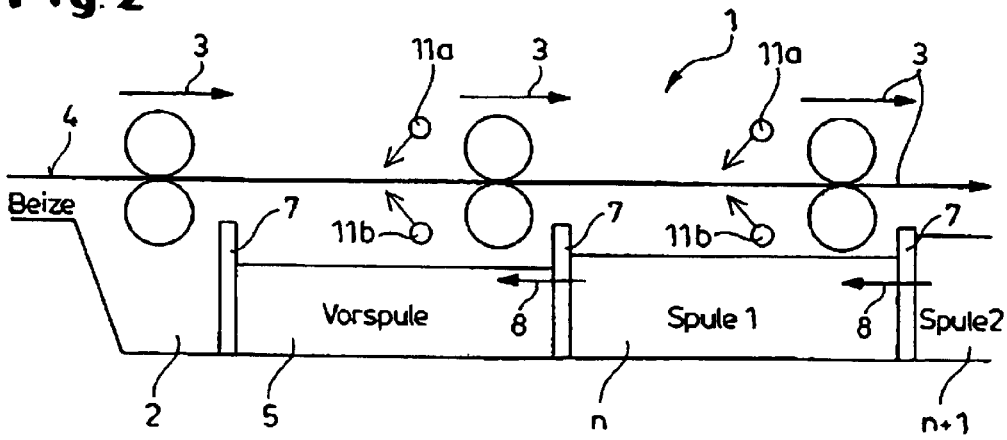
FIG. 2 a schematic view, at an increased, in comparison with FIG. 1, scale, of an inlet section of the cascade washer following the strip treatment means.

A counterflow cascade washer 1, which is arranged downstream of a treatment means 2, e.g., means for pickling a continuous metal strip 4 displaceable in a direction shown with arrow 3, includes a forewasher unit 5 and a plurality of washer units following the forewasher unit 5, namely, n, n+1, n+2, n+3. Fresh water is fed into the last washer unit or the washer unit n+3 via a conduit 6 from a fresh water units or forewasher unit 5, and washer units n, n, n+2, and n+3 are separated from each other by gates 7 (please see also FIG. 2). Each of the washer units n, n+1, n+2, n+3 is associated with a respective rinsing water circuit I–IV through which rinsing water is fed to respective washer units. The rinsing water is applied to the strip 4 through the nozzle arrangements 9 each including upper and lower blast pipes arranged above and below the running strip 4. Maintaining of the cascade flow in the counterflow direction, which is shown in FIG. 2 with arrows 8, is effected by branching of a bypass stream from the respective rinsing water circuits I–IV and not by overflow over the gates 7. To this end, a separate bypass conduit 10 is integrated in each of the rinsing water circuit I through IV. Through a respective bypass conduit 10, a portion of the water stream is branch and is fed from a respective washer unit to an end of a washer unit which is located upstream of the feeding washer unit in the displacement direction 3 of the strip 4, e.g., a bypass stream portion is fed from the washer unit n+1 to the washer unit n. At the end of each bypass conduit 10, there is provided a nozzle arrangement 11 which includes upper and lower blast pipes 11*a*, 11*b* located above and below the strip 4 (please see FIG. 2 that shows a mirror image of the arrangement of the washer units shown in FIG. 1).

As a result of the provision of the bypassing stream portions, the strip 4 is subjected at each upstream washer unit to additional rinsing by a small amount of rinsing water fed from the downstream washer unit n+1, n+2, n+3. Thus, a minimal cascade flow, which is always necessary for the operation of the counterflow cascade washer and, thereby, a carry-over of chemicals and foreign residues from a downstream washer unit to the adjacent upstream washer unit are maintained without the overflow of the rinsing water over the gates 7.

Though the present invention was shown and described with references to the preferred embodiment, such is merely illustrative of the present invention and is not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A method of operating a counterflow cascade washer for wet-chemical treatment of a surface of a metal strip and to be located downstream of one of treatment means and aftertreatment means of a metal strip treating installation, with the counterflow cascade washer including a plurality of washer units each having means for connecting a respective washer unit with a fresh water supply and a rinsing water circuit, the method comprising the steps of branching a portion of a water flow, which circulates through a rinsing water circuit associated with each of the washer units, off in form of a bypass stream; and feeding the bypass stream to a washer unit located immediately upstream of a respective washer unit for additionally rinsing the metal strip in the immediately upstream washer unit with a rinsing water containing a smaller concentration of foreign additives than a rinsing water with which the metal strip is first treated in the immediately upstream washer unit; and dividing the bypass stream at an end of the immediately upstream washer unit and feeding the divided water stream to locations above and below the metal strip.

* * * * *